US008162311B2

(12) United States Patent
Shinohara

(10) Patent No.: US 8,162,311 B2
(45) Date of Patent: Apr. 24, 2012

(54) PLACING TABLE AND LIQUID BODY DISCHARGE DEVICE

(75) Inventor: Toru Shinohara, Suwa (JP)

(73) Assignee: Seiko Epson Corporation (JP)

( * ) Notice: Subject to any disclaimer, the term of this patent is extended or adjusted under 35 U.S.C. 154(b) by 618 days.

(21) Appl. No.: 12/356,154

(22) Filed: Jan. 20, 2009

(65) Prior Publication Data

US 2009/0202284 A1 Aug. 13, 2009

(30) Foreign Application Priority Data

Feb. 8, 2008 (JP) ..... 2008-028491

(51) Int. Cl.
*B65H 3/64* (2006.01)

(52) U.S. Cl. ..... 271/112; 271/109; 270/58.12

(58) Field of Classification Search .... 270/58.01–58.34; 400/646–648; 271/109, 112, 225, 226
See application file for complete search history.

(56) References Cited

U.S. PATENT DOCUMENTS 6,180,196 B1 * 1/2001 Glover et al. ..... 428/34
7,669,842 B2 * 3/2010 Smith ..... 270/58.07

FOREIGN PATENT DOCUMENTS

JP 2006-167704 6/2006

* cited by examiner

*Primary Examiner* — Seung Lee
*Assistant Examiner* — Christle Marshall
(74) *Attorney, Agent, or Firm* — Harness, Dickey & Pierce, P.L.C.

(57) ABSTRACT

A placing table includes a placing surface on which a substrate is placed; a suction unit which sucks the substrate to the placing surface; a separation unit which separates the substrate from the placing surface; and a rotation unit, being a part of the placing surface and rotating about a vertical axis with respect to the placing surface. In the table, the suction unit sucks the substrate to the placing surface at the rotation unit and the separation unit separates the substrate from a part of the placing surface excluding the rotation unit if the rotation unit is rotated.

5 Claims, 11 Drawing Sheets

PLACING TABLE AND LIQUID BODY DISCHARGE DEVICE

BACKGROUND

1. Technical Field

The present invention relates to a placing table and a liquid body discharge device including the placing table.

2. Related Art

There have been liquid body discharge devices that discharge liquids such as functional liquids and ink to substrates made of glass, ceramic, resin, or silicon to form (also referred to as "draw") predetermined patterns (also referred to as "drawing patterns") on the substrates. One of such devices includes a carriage in which a discharge mechanism and a circuit substrate to control the discharge mechanism are built. The discharge mechanism discharges a liquid body by applying a pressure to the liquid body in a pressure chamber provided in a middle of a flow path through which the liquid body flows by using an electrostrictive property of a piezoelectric element or thermal energy. The liquid body to which the pressure is applied is discharged from a nozzle located at an end of the flow path formed in the carriage. A plurality of nozzles is commonly formed as a nozzle group. The nozzles are aligned in a nearly straight line as an alignment direction with a predetermined nozzle distance (pitch).

When color filters are formed on a single substrate by drawing patterns using such a liquid body discharge device, there is a case where liquid discharged regions to which color liquids of R (red), G (green), and B (blue) are discharged, i.e., the drawing pattern of drawing regions of color pixels in a first color filter is different from that of a second color filter. In a case where a plurality of color filters corresponding to different display sizes from one another is formed on a single substrate and color pixels corresponding to R, G, and B have a rectangular shape with a longitudinal direction, a drawing pattern of a first color filter differs from a drawing pattern of a second color filter. For example, the longitudinal direction of the color pixels included in one drawing pattern is orthogonal to that of the color pixels included in another drawing pattern. Since the longitudinal directions of the color pixels of the color filters are orthogonal to each other, a pitch between the color pixels adjacent to each other in the first color filter is shorter than a pitch between the color pixels in the second color filter when they are viewed from the longitudinal direction of the color pixels of the second color filter. In this case, when each color liquid body is discharged from the nozzles that are formed in a manner being aligned in a predetermined alignment direction in the carriage so as to form color pixels by drawing in the plurality of color filters, the following problem may occur. If the alignment direction of the nozzles is substantially in parallel with the longitudinal direction of each of the color pixels, the color pixels can be formed. In contrast, if the alignment direction of the nozzles is substantially orthogonal to the longitudinal direction of the color pixels, some color pixels are not formed because the pixel pitch is short in the alignment direction of the nozzles.

To cope with such a problem, each drawing pattern needs to be optimized in a direction based on the alignment direction. JP-A-2006-167704 is an example of related art. It discloses a technique in which the substrate is lifted and lowered and rotated.

With the technique disclosed in the example, the substrate is rotated, and the drawing pattern is optimized in the direction of the alignment direction so that color pixels can be formed by drawing. However, the technique disclosed in the example has a structure that a part of a surface of a table is lifted when the substrate is lifted so that the substrate may be deformed and damaged in a worst case. In addition, the lifting and lowering is necessary, thus it takes a considerable amount of time to rotate the substrate.

SUMMARY

An advantage of the invention is to provide a placing table which can rotate a substrate over the placing table without lifting and lowering a part of a surface of the placing table to reduce a rotation time.

According to a first aspect of the invention, a placing table includes a placing surface on which a substrate is placed; a suction unit which sucks the substrate to the placing surface; a separation unit which separates the substrate from the placing surface; and a rotation unit, being a part of the placing surface and rotating about a vertical axis with respect to the placing surface. In the table, the suction unit sucks the substrate to the placing surface at the rotation unit and the separation unit separates the substrate from a part of the placing surface excluding the rotation unit if the rotation unit is rotated.

In the table, the substrate can be rotated over the placing table without lifting and lowering a part of a surface of the placing table. Therefore, an amount of time to lift and lower the substrate can be eliminated so as to reduce the rotation time. In addition, since a lifting and lowering unit is unnecessary, a structure of the rotation unit can be simplified.

In the placing table, the suction unit may not suck the substrate at an edge part of the rotation unit.

In the table, at a non-rotating part adjacent to a rotating part of the surface of the placing table, the substrate can be easily separated from the surface of the placing table. Therefore, a friction between the surface of the placing table and the substrate can be suppressed so that the substrate can be rotated smoothly.

In the placing table, the rotation unit may be in a circular shape when viewed vertically to the placing surface.

In the table, at the non-rotation part adjacent to the rotating part of the surface of the placing table, a space required in accordance with the rotation can be minimized. As a result, a deformation of the substrate due to the space can be suppressed so that the substrate can be rotated stably.

In the placing table, an opening hole may be provided to the placing surface. In the table, the separation unit may blow a gas from the opening hole.

In the table, the substrate can be separated by the gas blowing from the opening hole provided at the surface of the placing table so that the separation unit can be structured easily. Especially, when air is employed as the gas, the separation unit can be structured easily and a structure of the separation unit can be simplified.

In the placing table, the opening hole may be formed in an oblique direction with respect to the placing surface, and the separation unit may blow the gas from the opening hole formed in the oblique direction so that the substrate may be separated and the rotation unit may be rotated.

In the table, the substrate can be separated and rotated by the gas blown. Therefore, the substrate can be separated and rotated simultaneously so that a rotation time of the substrate is expected to be shorter. In addition, since it is not necessary to form a lifting and lowering unit separately, a structure of the rotation unit can be simplified.

In the placing table, the placing surface includes an opening hole formed in a nearly vertical direction with respect to the placing surface, and the separation unit may blow the gas from the opening hole formed in the vertical direction so that the whole substrate is separated from the placing surface.

In the table, when the substrate is rotated, a compressed air is blown from the opening hole which is formed in the oblique direction so as to rotate the substrate by the compressed air. On the other hand, when the substrate is removed from the device, the gas is blown from the opening hole which is formed in the vertical direction so that the rotation of the substrate by the gas can be suppressed. Accordingly, a removing operation of the substrate from the placing table can be easier.

According to a second aspect of the invention, a liquid body discharge device including the placing table according to claim 1, and a liquid body discharge unit that discharges a liquid body to the substrate with a nozzle.

According to the device, the substrate can be rotated while it remains on the placing table without lifting and lowering it. The liquid body is discharged to the substrate with the nozzle before and after the rotation of the substrate. As a result, when it is necessary to discharge the liquid body to the rotated substrate with the nozzle, the substrate can be rotated in a short time while it remains on the placing table. It makes it possible to achieve the liquid body discharge device which reduces a time required to start discharging the liquid body after the rotation of the substrate.

BRIEF DESCRIPTION OF THE DRAWINGS

The invention will be described with reference to the accompanying drawings, wherein like numbers reference like elements.

FIG. 2A is a plan view of the placing table, and FIG. 2B is a cross sectional view of the placing table.

FIG. 11A is a plan view of the placing table, and FIG. 11B is a cross sectional view of the placing table.

DESCRIPTION OF EXEMPLARY EMBODIMENTS

Figure 1:
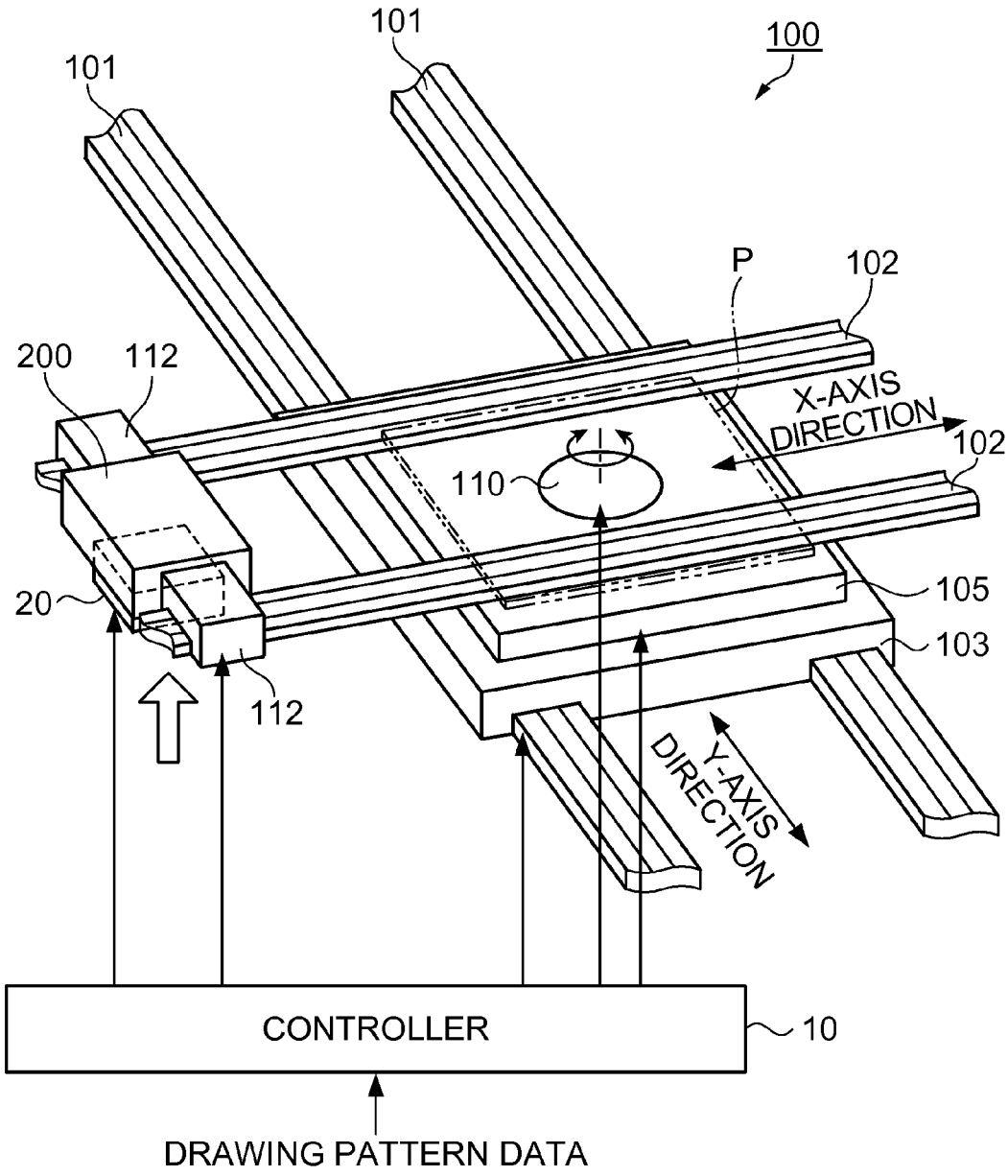
FIG. 1 is a perspective view showing a schematic structure of a liquid body discharge device of an embodiment.

An embodiment of the invention will now be described below. FIG. 1 is a perspective view showing a schematic structure of a liquid body discharge device 100 of the embodiment. The liquid body discharge device 100 of the embodiment is a device to form a color filter by discharging color liquid bodies in red (R), green (G), and blue (B) respectively on color pixels formed on a substrate P. The substrate P is an object to be discharged and the color pixels are regions to be discharged.

As shown in FIG. 1, the liquid body discharge device 100 is provided with a pair of guide rails 101 that are linearly formed, and a moving stage 103 that moves in a linear axis direction (referred to as a Y-axis direction in the embodiment) by air sliders and linear motors (not shown) disposed inside the guide rails 101. On the moving stage 103, a placing table 105 for placing the substrate P is disposed. The placing table 105 includes a suction unit and a separation unit. The suction unit sucks the substrate P to a table surface which serves as a placing surface for placing the substrate P. The separation unit can separate the substrate P from the table surface. The placing table 105 includes a rotation unit 110. The rotation unit 110 is a part of the table surface which is formed separately from remaining parts of the placing table 105, and rotates about a single axis which is perpendicular to the table surface.

Figure 2A:
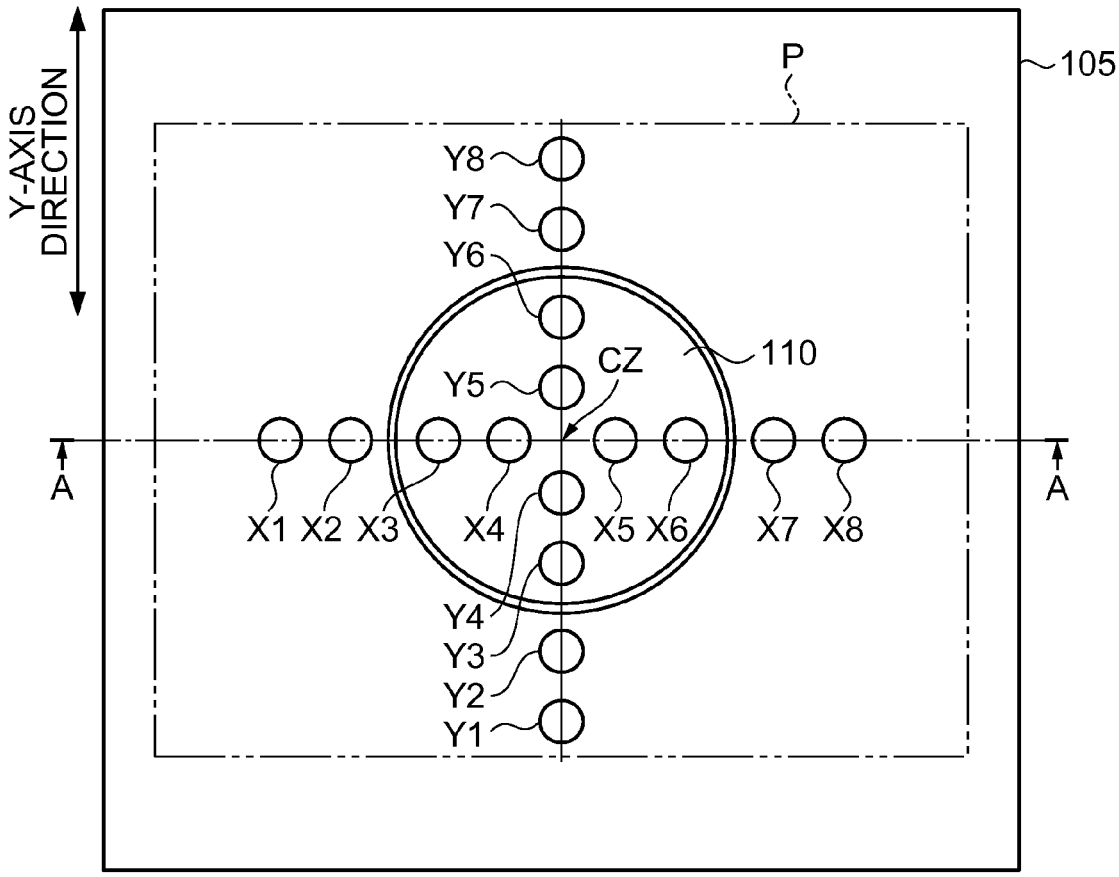
FIGS. 2A and 2B are structure views schematically showing a suction unit and a separation unit included to a placing table.
Figure 2B:
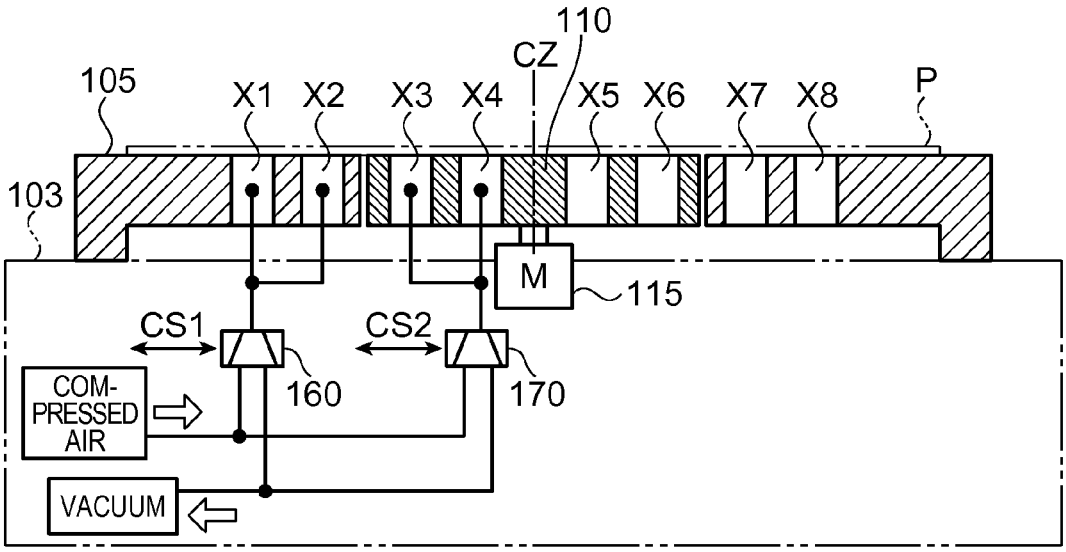

The suction unit, the separation unit, and the rotation unit 10 will be described in details with reference to FIGS. 2A and 2B. FIGS. 2A and 2B are structure views schematically showing the suction unit and the separation unit included to the placing table 105. FIG. 2A shows the placing table 105 when it is viewed from an upper direction which is a direction opposite from the moving stage 103 with respect to the placing table 105. (A direction opposite to the upper direction is referred to as a lower direction.) FIG. 2B is a cross sectional view taken along a line A-A of the placing table 105 in FIG. 2A.

As shown in the drawing, the rotation unit 110 is a part of the placing table 105. The rotation unit 110 is in a circular shape, and has an axis perpendicular to its table surface so as to be adapted to be rotated about a center position of the circular shape as a rotation center CZ. The rotation unit 110 has a structure that a rotation of the rotation unit 110 is controlled by a rotary motor 115 disposed inside the placing table 105 or the moving stage 103.

It is preferable that the rotation unit 110 is in a circular shape and its rotation center is a center of the circular shape as the embodiment. In this way, a space generated between the rotation unit 110 and a non-rotating part of the placing table 105 can be set as a space determined by variations of decentering of the rotation unit 110 when being rotated or manufacturing variations of the placing table 105. There is a high probability that the gap can be set at a minimum so that a deformation of the substrate caused by the gap can be suppressed in a case where a thin substrate is used for the substrate P. The rotation unit 110, of course, is not necessarily in a circular shape, may be in a rectangular shape as disclosed in the example of related art. The rotation center may be different from a center of the shape.

The placing table 105 including the rotation unit 10 is provided with a plurality of holes which are formed in a nearly vertical direction with respect to the table surface and have nearly circular openings. In the embodiment, holes Y1 to Y8 and X1 to X8, i.e., 16 holes are exemplified for simplifying the following explanation. Opening centers of the holes Y1 to Y8 are arranged in a straight line manner in the Y-axis direction while opening centers of the holes X1 to X8 are arranged in a straight line manner in a direction orthogonal to the Y-axis direction. The rotation unit 110 includes eight holes, i.e., the holes X3 to X6 and Y3 to Y6. Each hole is formed at a position point-symmetric to the rotation center CZ which serves as the center. However, needless to say, the plurality of holes is usually formed on almost entire surface of the placing table 105. In addition, the holes may not be formed at positions point-symmetric to the rotation center CZ.

Each hole formed as mentioned above is controlled to have a state in which a pressurized air is blown from the table surface side of the placing table 105 or a state in which the air is sucked into the table surface side of the placing table 105 on which the substrate P is placed.

More specifically, as shown in FIG. 2B, the holes X1 and X2 are coupled to the pressurized air (hereafter referred to as a compressed air) by a control valve 160 which is operated by a control signal CS1 so that the air blows from the holes X1 and X2. The compressed air is generated by a compressed air generating device (not shown), such as a press pump. In addition, the holes X1 and X2 are coupled to a vacuum or a depressurized air (hereafter referred to as the vacuum) so that the air is sucked into the holes X1 and X2. The vacuum is generated by a vacuum generating device (not shown), such as a vacuum pump. It is needless to say that the holes X7, X8, Y1, Y2, Y7, and Y8 (not shown due to omission) are controlled by the control valve 160 similarly as the holes X1 and X2.

The holes X3 and X4 are coupled to either the compressed air or the vacuum by a control valve 170 which is operated by a control signal CS2. It is needless to say that the holes X5, X6, Y3, Y4, Y5, and Y6 (not shown due to omission) are controlled by the control valve 170 similarly as the holes X3 and X4.

Flows of air between the control valves 160 and 170 and each hole X1 to X8 and Y1 to Y8, and between the control valves 160 and 170 and the compressed air and the vacuum are usually connected with a pipe. However, here and as well as the following description, the pipe is simplified and shown in full line. In the embodiment, the compressed air generating device and the vacuum generating device are included to the moving stage 103. The compressed air generating device and the vacuum generating device may not be included to the moving stage 103 as long as the pipe is formed therein.

As described above, each of the holes X1 to X8 and Y1 to Y8 is functioned as the separation unit from which the air is blown and the suction unit to which the air is sucked by controlling the control valves 160 and 170. Especially, when the air is employed for the separation unit, the air blown from the holes allows separating the substrate. Therefore, the separation unit can be structured easily and its structure can be simplified. In addition, a nitrogen gas or an oxygen gas may be employed instead of the air.

Referring back to FIG. 1, a pair of guide rails 102 is provided at a predetermined distance from the placing table 105 in the upper direction which is the direction opposite from the moving stage 103 with respect to the placing table 105. The guide rails 102 are provided to have a linear axis direction (hereafter referred to as an X axis direction in the embodiment).

The liquid body discharge device 100 is provided with a carriage 200 that moves along the pair of the guide rails 102. That is, the carriage 200 is provided with a carriage moving stage 112 at its both sides, and adapted to be movable along the X-axis direction with air sliders and linear motors (both not shown) disposed inside the guide rails 102. The carriage moving stage 112 is integrally or separately provided to the carriage 200.

The carriage 200 is provided with a nozzle head 20 at its lower direction side. The nozzle head 20 includes a plurality of nozzles and a discharge mechanisms. The nozzles are drilled and formed so as to show a predetermined alignment direction and discharge each color liquid body. Each of the nozzles is provided with the discharge mechanism so that the liquid body can be discharged. Then, each color liquid body supplied from a liquid body supplying mechanism (not shown) to the carriages 200 is respectively supplied to each nozzle head 20 through a flow path (not shown) formed in the carriage 200 and is discharged from the nozzles as a droplet by the discharge mechanism formed at each nozzle.

Figure 3:
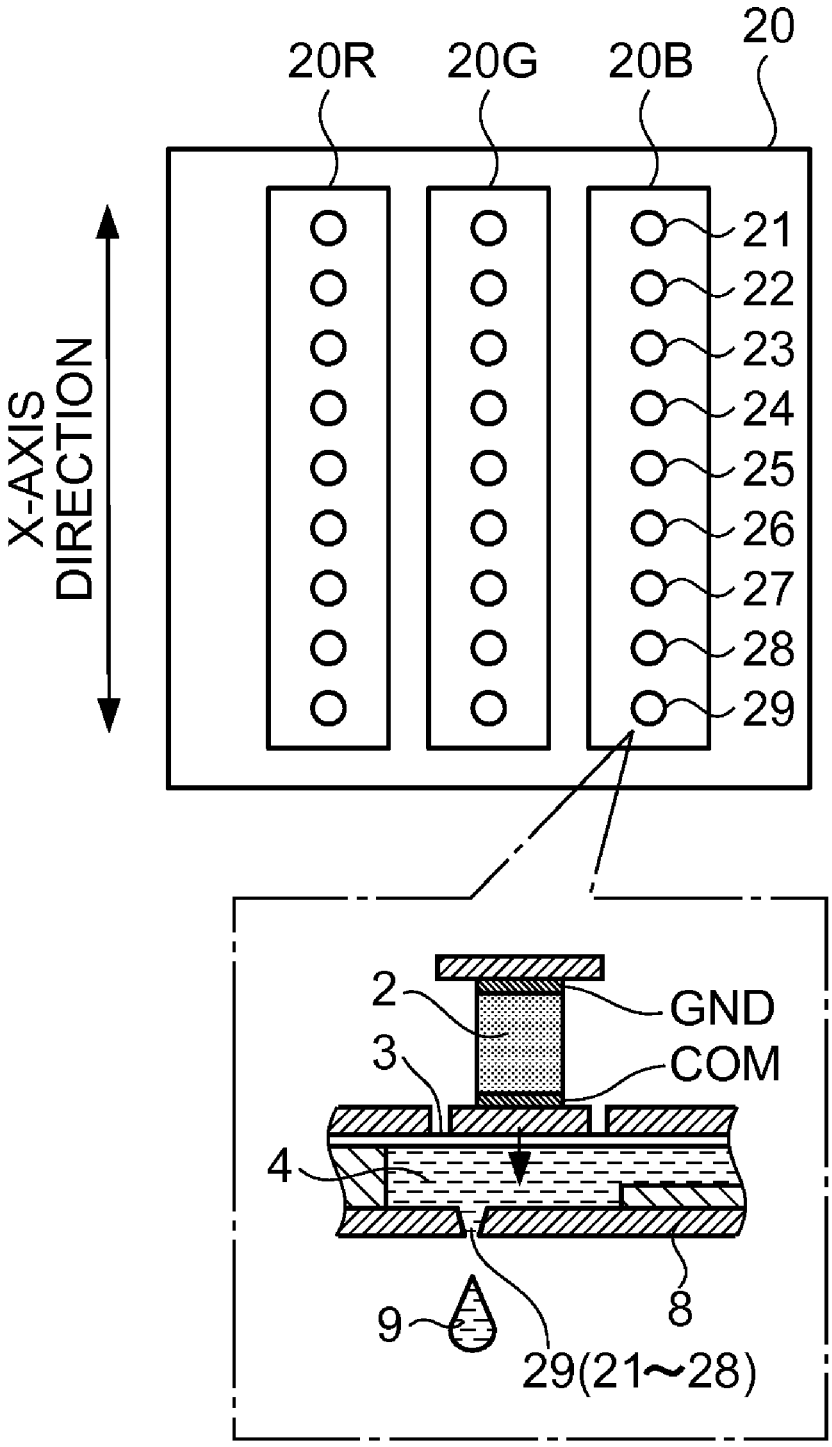
FIG. 3 is a schematic view showing alignment conditions of nozzles formed in a nozzle head.

The nozzles provided in the nozzle head 20 in the embodiment will be described with reference to FIG. 3. FIG. 3 is a schematic view showing alignment conditions of the nozzles formed in the each nozzle head 20 when viewed from the lower direction of the carriage as indicated by an outlined arrow in FIG. 1. Here, the X-axis direction is shown in the drawing.

In the embodiment, as shown, the nozzle head 20 is provided with nozzle groups 20R, 20G, and 20B for discharging each color liquid body corresponding to R, G, and B. Each of the nozzle groups 20R, 20G, and 20B has a nozzle row in which the nozzles 21 to 29, i.e., nine nozzles are aligned in a nearly straight line. The alignment direction of the nozzles coincides with the X-axis direction. The nozzle raw does not always coincide with the X-axis direction, and may oblique with respect to the X-axis direction.

Each of the nozzles drilled and formed in the nozzle head 20 is provided with the discharge mechanism so as to discharge the liquid body of a predetermined amount from the nozzles by applying pressure to the liquid body in the nozzle head 20. The discharge mechanism for all nozzles has similar configurations.

The discharge mechanism has a structure as shown in a balloon in FIG. 3 in the embodiment, and includes a piezoelectric element 2 serving as a driver (an actuator). When a predetermined voltage waveform is applied between an electrode COM and an electrode GND that are disposed at opposite ends of the piezoelectric element 2, the piezoelectric element 2 is deformed and contracted or deformed and extended by an electrostrictive property, resulting in pressurizing each pressurized color liquid body in a pressure chamber 4 formed in the middle of the liquid flow path. As a result, each pressurized color liquid body is discharged as a droplet 9 from the nozzle 29 (i.e. nozzles 21 to 28) drilled and formed in a bottom member 8 of the nozzle head 20. Alternatively, a so-called thermal system using a heating element as the actuator can be also employed, for example, as the discharge mechanism.

In the embodiment, the nozzle groups having nine nozzles are exemplified for simplifying the explanation. However, several tens to several hundreds of nozzles are respectively formed in a predetermined pitch in practice. In addition, each of the nozzle groups may include a plurality of nozzle rows, such as two nozzle rows. In a case of two nozzle rows, the nozzles are drilled and formed such that one nozzle row is shifted by a half pitch with respect to the other nozzle row to form a zigzag alignment, for example. Further, a plurality of nozzle groups may be formed corresponding to each color liquid body. In the embodiment, all pitches between the nozzles formed in each nozzle group are same as each other. The pitches, of course, may be different from each other.

Referring back to FIG. 1, the liquid body discharge device 100 is provided with a controller 10. The controller 10 controls: a movement of the moving stage 103 in the Y-axis direction, i.e., a movement of the substrate P in the Y-axis direction; a movement of the carriage moving stage 112 provided to the carriage 200 in the X-axis direction, i.e., the movement of the carriage 200 in the X-axis direction; the driving of the discharge mechanism formed in the nozzle head 20, i.e., the discharging the liquid body; and the rotation of the rotation unit 110 of the placing table, by using a drawing pattern data drawn on the substrate P. In the embodiment, the drawing pattern data is a coordinate data in which each of color pixels of a color filter is defined as a coordinate position on the substrate P.

The controller 10 controls the suction unit and the separation unit at a drawing process of the drawing pattern so that the substrate P is sucked to the table surface of the placing table 105 or separated from the table surface.

Figure 4:
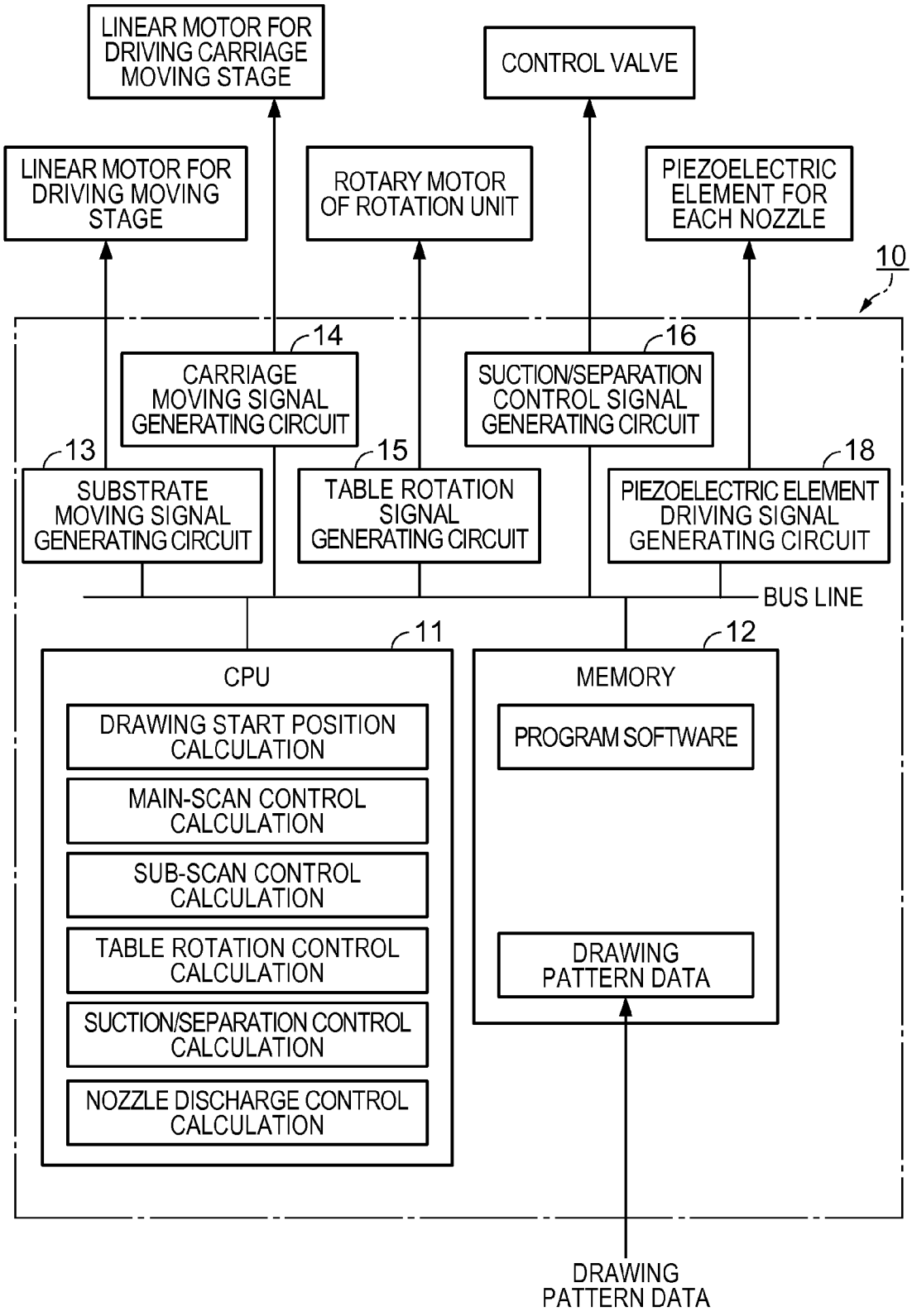
FIG. 4 is a block diagram explaining a function of a controller.

Next, the controller 10 will be described with reference to a block diagram shown in FIG. 4. The controller 10 includes, as shown in FIG. 4, a CPU 11, a memory 12, a substrate moving signal generating circuit 13, a carriage moving signal generating circuit 14, a table rotation signal generating circuit 15, a suction/separation control signal generating circuit 16, and a piezoelectric element driving signal generating circuit 18 that are coupled to each other through a bus line. Each output signal of the substrate moving signal generating circuit 13, the carriage moving signal generating circuit 14, the table rotation signal generating circuit 15, the suction/separation control signal generating circuit 16, and the piezoelectric element driving signal generating circuit 18 is respectively outputted as a predetermined voltage signal to a linear motor for driving the moving stage 103, a linear motor for driving the carriage moving stage 112, the rotary motor 115 of the rotation unit 110, the control valves 160 and 170, and the piezoelectric element for each nozzle through an interface (not shown) as necessary.

The CPU 11 executes a drawing start position calculation, a main-scan control calculation, a sub-scan control calculation, a table rotation control calculation, a suction/separation control calculation, and a nozzle discharge control calculation in order to form a predetermined drawing pattern on the substrate P by discharging each color liquid body based on the drawing pattern data which is inputted to the controller 10 and stored in the memory 12 through the interface (not shown) or the like.

Here, a main-scan means a movement while the liquid bodies are discharged from the nozzles during the relative movement between the substrate P and the nozzles. A sub-scan means a movement without discharging liquid bodies from the nozzles after one main-scan and before next main-scan in a path during the relative movement between the substrate P and the nozzles.

The CPU 11 controls the substrate moving signal generating circuit 13 and the carriage moving signal generating circuit 14 based on the calculated control data of the main-scan and the sub-scan so as to generate and output a driving signal for each linear motor. The CPU 11 controls the table rotation signal generating circuit 15 based on the calculated rotation control data so as to generate and output a driving signal of the rotary motor 115. In addition, the CPU 11 controls the suction/separation control signal generating circuit 16 based on the calculated control data of the suction and separation in accordance with the rotation of the rotation unit 110 so as to generate control signals CS1 and CS2 for the suction and separation and respectively output them to the control valves 160 and 170. Furthermore, the CPU 11 controls the piezoelectric element driving signal generating circuit 18 based on the calculated control data to discharge each color liquid body from the nozzles during the main-scan so as to generate a driving signal and output to the piezoelectric element of each nozzle.

Accordingly, the liquid body discharge device 100 of the embodiment allows the nozzle groups 20R, 20G, and 20B to relatively move with respect to the substrate P by moving the moving stage 103 and the carriage moving stage 112, and switching a placing direction of the substrate P by the rotation control of the rotation unit 110. In addition, by controlling the discharge mechanism formed at each nozzle controls ON (to discharge) and OFF (not to discharge) states of the liquid bodies. As a result, the liquid body is discharged at a position along a main-scanning trajectory of the nozzles 21 to 29 so that a predetermined pattern is drawn on the substrate 9. In each of the nozzle groups, a few nozzles positioned at an end are sometimes not used in view of the difference in discharging characteristics from other nozzles.

Figure 5:
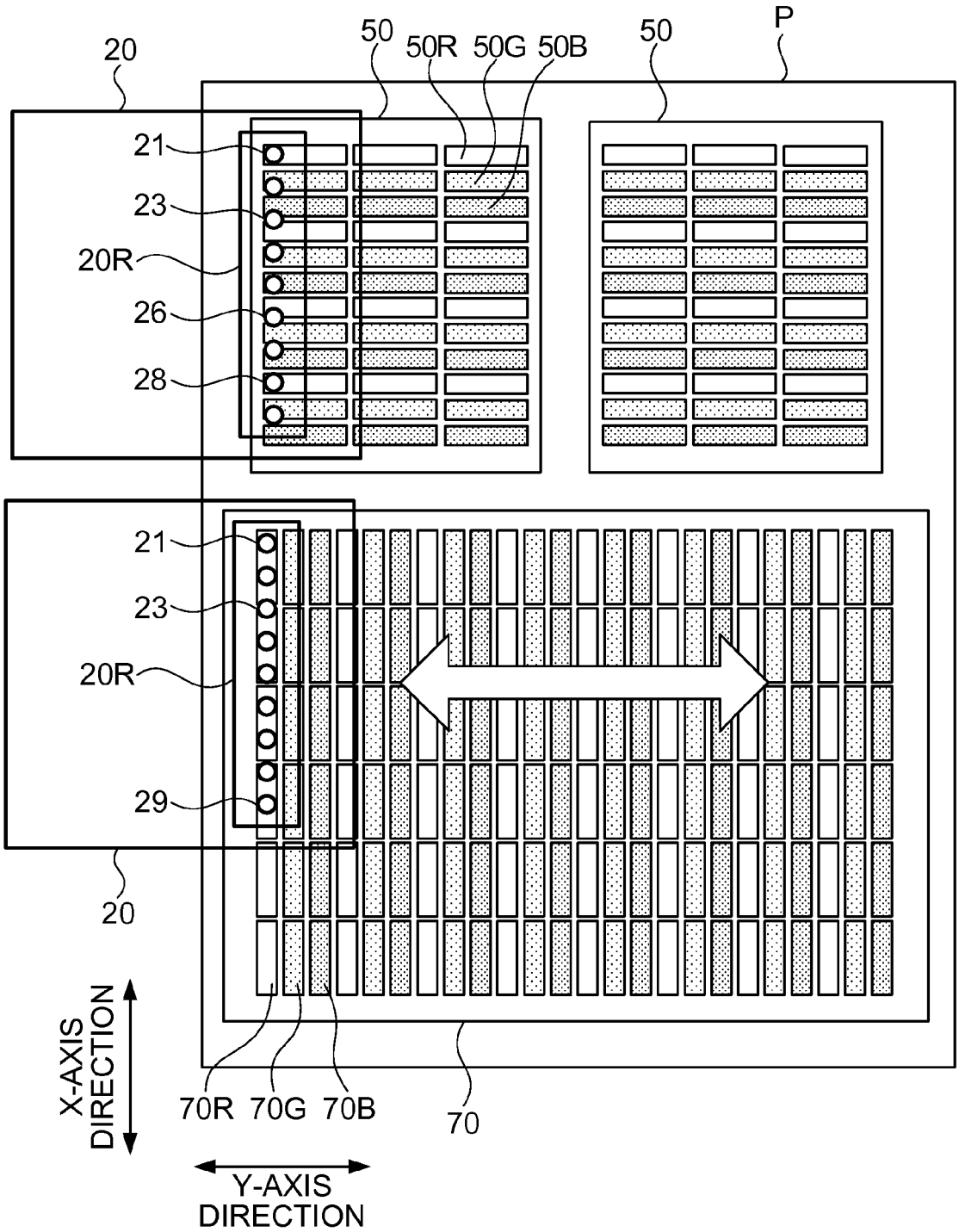
FIG. 5 is an explanatory view explaining a method for drawing a pattern to form a color filter on a substrate according to the embodiment.

Subsequently, in a case of forming drawing patterns that are different from each other on the substrate P, the drawing process by the liquid body discharge device 100 of the embodiment will be described. Prior to this, an outline of the process is described with reference to FIG. 5. FIG. 5 is an explanatory diagram viewed from the top of the substrate P and showing a relation of liquid body discharged regions of respective colors formed on the substrate P and the nozzle heads 20. Here, the nozzle heads 20 are shown in a transparent view. In addition, sizes of the liquid body discharged regions of the each color liquid body and the nozzle heads 20 are exaggeratingly shown for the description.

FIG. 5 shows a state in which one piece of a color filter 70 for a large-sized screen and two pieces of a color filter 50 each for a small-sized screen are formed on the substrate P. The color filter 70 has a drawing pattern in which the liquid body discharged regions (color pixels) of a rectangular shape having a longitudinal direction extending in a direction orthogonal to the Y-axis direction are formed in a matrix. The liquid body discharged regions are regions 70R, 70G, and 70B to which each color liquid body R, G, and B are repeatedly and subsequently discharged along the Y-axis direction to form a stripe arrangement. The regions are separated from each other with a bank made of resin or the like. On the other hand, the color filter 50 has a drawing pattern in which the liquid body discharged regions of a rectangular shape having a longitudinal direction extending in the Y-axis direction are formed in a matrix. The liquid body discharged regions are regions 50R, 50G, and 50B to which each color liquid body R, G, and B are repeatedly and subsequently discharged along the direction orthogonal to the Y-axis direction to form a stripe arrangement. The regions are separated from each other with a bank made of resin or the like.

In the embodiment, the Y-axis direction is orthogonal to the X-axis direction. Therefore, the color filter 50 and the color filter 70 have drawing patterns in which the longitudinal directions of each liquid body discharged region separated in a rectangular shape are respectively the X-axis and the Y-axis. That is, the longitudinal directions of the liquid body discharged region of the color filter 50 and that of the color filter 70 are orthogonal to each other. In regard to the drawing patterns to be formed on the substrate P, when a pattern of a color filter for a large-sized screen and a pattern of another color filter for a small-sized screen are simultaneously drawn as described above, a case frequently occurs in which the drawing patterns are different from each other, e.g., the longitudinal directions are orthogonal to each other. This case is caused by an attempt of efficient utilization of the regions of the substrate P.

Now, a case will be exemplified in which patterns to form the color filter 50 and the color filter 70 are drawn on the substrate P by using the carriage 200 regarding the Y-axis direction as the main-scan direction as indicated by an outlined arrow in the drawing. Then, a case is assumed in which a liquid body R is discharged from the nozzles 21 to 29 in the nozzle group 20R disposed to the nozzle head 20 to the regions 50R and 70R to which the liquid body R is discharged. The following description is also applicable to the nozzle groups 20G and 20B although drawing and description thereof will be omitted.

In this case, as shown, nozzles other than a nozzle 23 among the nozzles 21 to 29 can discharge the liquid body R to the whole region 70R overlapped with a scanning trajectory of the nozzles in the color filter 70 with a single main-scan. In contrast, in the color filter 50, an interval between the regions (i.e., a color pixel pitch) in an alignment direction of the nozzles for the regions 50R, 50G, and 50B are short, i.e., a width of the region 50R is narrow. Therefore, nozzles 21 and 28 among the nozzles 21 to 29 can discharge the liquid body R to the regions 50R, but nozzles 23 and 26 become hard to discharge the liquid body R to the regions 50R. Accordingly, in the case of the color filter 50, the nozzle head 20 is required to be moved in the X-axis direction, i.e., moved as the sub-scan, so as to be in a position in which the nozzles are overlapped with the regions 50R in plan view, and then the main-scan needs to be repeated at each time. This increases the number of main scans, thereby taking longer time to complete the drawing.

In a case of the color filter 50, when the alignment direction of the nozzles is changed by rotating the nozzle head 20, nozzle pitches become narrow so that the nozzle 26 becomes able to discharge the liquid body R to the regions 50R while the nozzle 28 becomes unable to discharge the liquid body R to the regions 50R. Therefore, in such a case, operations, e.g., removing the substrate from the device, rotating by 90 degrees, and resetting it on the device, are necessary so that productivity becomes lowered.

In such the case, in the embodiment, the substrate P is rotated 90 degrees while it remains on the placing table 105 without removing from the device so that the longitudinal direction of the liquid body discharged regions of the color filter 50 becomes the X-axis direction. As a result, the nozzle head 20 is moved as the main-scan in the Y-axis direction so that the patterns can be drawn on the color filter 50 in the same manner as the color filter 70.

Referring now to a flowchart shown in FIG. 6, the drawing process performed by the liquid body discharge device 100 of the embodiment will be described. The procedures of this process are stated in a program software (refer to FIG. 4) stored in the memory 12. The CPU 11 reads and executes the program software.

In a step S101, the substrate is sucked. The CPU 11 controls the control valves 160 and 170, and couples all of the holes X1 to X8 and Y1 to Y8 to the vacuum so that the substrate P placed on a predetermined position of the placing table 15 is sucked to the table surface.

Then, in a step S102, a drawing pattern A to which each color liquid body is discharged is obtained. The drawing pattern data is inputted into the memory 12 of the controller for every substrate P sucked and fixed to the placing table 105 shown in FIG. 1. The CPU 11 reads data of the drawing pattern A from the inputted data of the drawing pattern data A. In the embodiment, the drawing pattern in which each color pixel of the color filter 70 forms is referred to as the drawing pattern A while the drawing pattern in which each color pixel of the color filter 50 forms is referred to as a drawing pattern B.

In the embodiment, the substrate P is preliminary sucked and fixed to the placing table 105 so that the longitudinal direction of the drawing pattern of the color filter 70 is in the X axis direction. Accordingly, the CPU 11 reads a coordinate data of each color pixel so as to calculate the read coordinate data and obtain the drawing pattern A of which the longitudinal direction is in the X-axis direction.

In a step S103, the carriage is positioned. In order to draw color patterns of R, G, and B to the color filter 70, the CPU 11 drives the linear motors for moving the carriage moving stage 112 in the carriage 200 along the guide rails 102 so as to position the carriage 200 at a drawing start position calculated by the data of the drawing pattern A.

Figure 7:
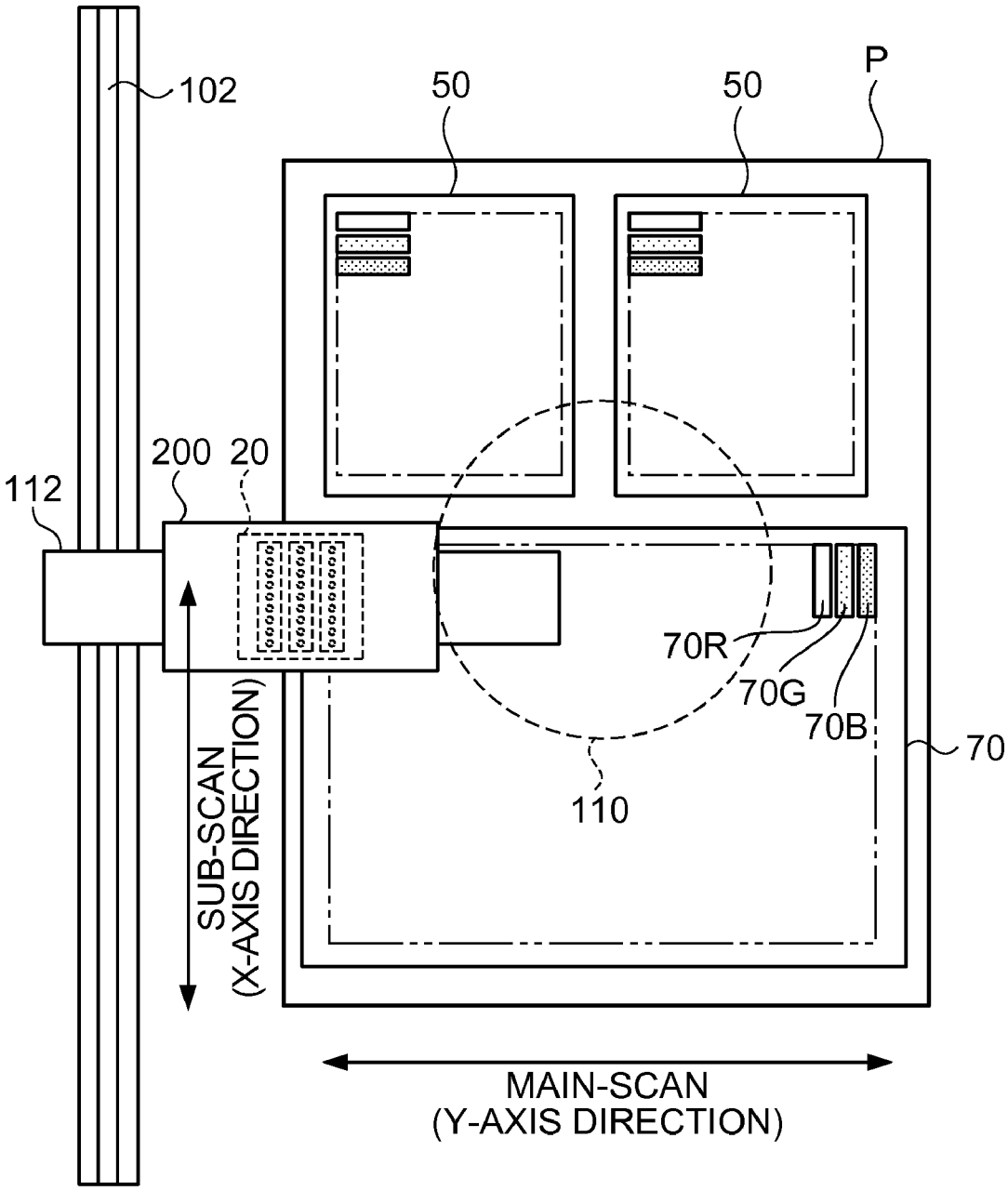
FIG. 7 is a schematic view showing a state in which the pattern to form the color filter is drawn by the nozzle head.

Next, in a step S104, the substrate is moved as the main-scan (in the Y-axis direction) and the carriage is moved as the sub-scan (in the X-axis direction) so as to draw the drawing pattern A. This processing will be explained with reference to FIG. 7. FIG. 7 is a schematic view showing a state in which the pattern of the color filter 70 is drawn by the nozzle head 20 included in the carriage 200 when the substrate P is viewed from the upper direction. One of the pair of guide rails 102 (in the right side of the drawing) is omitted so as to simplify the drawing.

As shown, the substrate P is moved along the pair of guide rails 101 (not shown) in the Y-axis direction as the main-scan. During the main-scan, the piezoelectric element in the discharge mechanism provided to each nozzle of the nozzle head 20 included to the carriage 200 is driven so as to discharge each color liquid body to the regions 70R, 70G, and 70G (FIG. 7 shows only a part of the regions) from the respective nozzles. On the other hand, the carriage 200 is moved along the pair of the guide rails 102 in the X-axis direction as the sub-scan. At each time of the sub-scan of the carriage 200, the substrate P is repeatedly moved as the main-scan so as to discharge each color liquid body to all of the regions 70R, 70G, and 70G. The drawing pattern A which is the drawing pattern for the color filter 70 is thus drawn.

Referring back to FIG. 6, in a step S105, the suction/separation is controlled so as to rotate the substrate. The CPU 11 respectively outputs the control signals CS1 and CS2 to the control valves 160 and 170 so as to control the suction and separation of the substrate P. The CPU 11 simultaneously outputs the driving signal to the rotary motor 115 so as to rotate the rotation unit 110 and the substrate P placed on the placing table 105.

Figure 8:
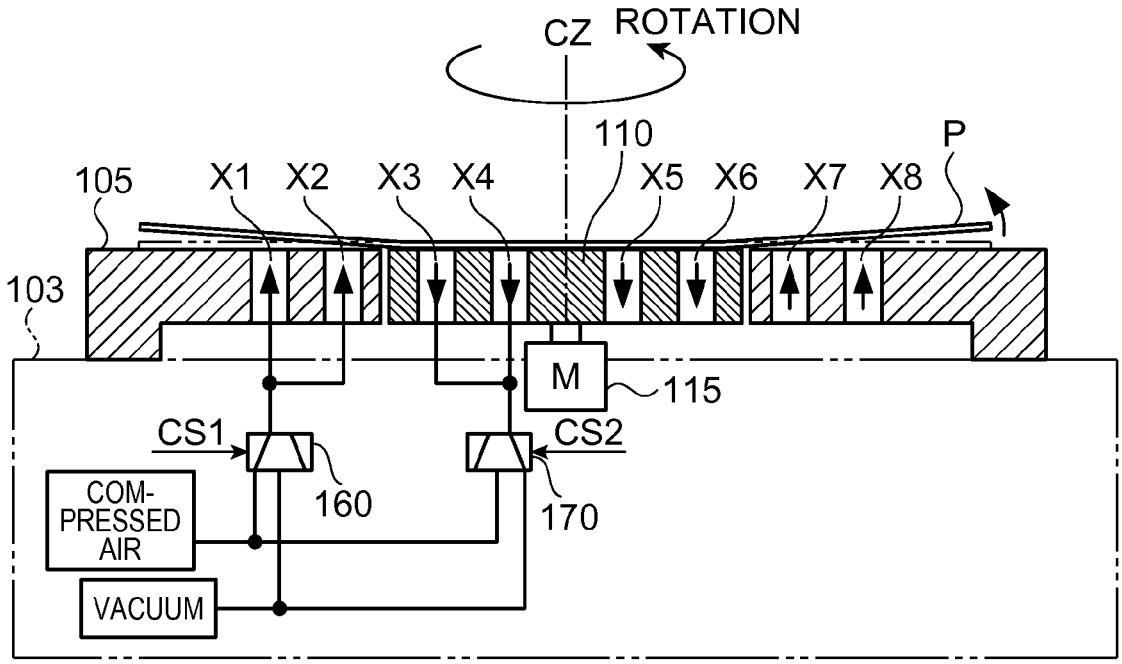
FIG. 8 is a schematic view explaining a rotation of the substrate of the embodiment.

This processing will be explained with reference to FIG. 8. FIG. 8 is a cross sectional view taken along the line A-A of the placing table 105 in the same manner as shown in FIG. 2B. As shown, in the step S105, the control valve 160 couples the holes X1, X2, X7, and X8 (Y1, Y2, Y7, and Y8 (refer to FIG. 2A)) to the compressed air by the control signal CS1. On the other hand, the control valve 170 couples the holes X3, X4, X5, and X6 (Y3, Y4, Y5, and Y6 (refer to FIG. 2A)) to the vacuum by the control signal CS2.

As a result, as shown, a part of the substrate P which is placed over the rotation unit 110 is sucked to the surface of the placing table 105 by the vacuum. However, a remaining part placed other than the rotation unit 110 of the substrate P is separated from the surface of the placing table 105 by the compressed air. Accordingly, as shown, the substrate P shows a concave shape in which a part contacting the rotation unit 110 serving as a bottom part, and a peripheral of the substrate P is separated.

In the step S105, while the substrate P is maintained in this condition, the rotary motor 115 of the rotation unit 110 is operated and rotated so as to be rotated by predetermined degrees (90 degrees). Then, the substrate P is rotated with the rotation unit 110 since it is sucked thereto. At this time, on the surface part of the placing table 105 which is placed other than the rotation unit 110, the substrate P is separated with the compressed air blown from the holes X1, X2, X7, and X8 (Y1, Y2, Y7, and Y8). Therefore, the surface of the placing table 105 and the substrate P can be rotated without any friction.

Thereafter, in the step S105, when the substrate P is rotated by the predetermined degrees, the control valve 160 is controlled by the control signal CS1, and the holes X1, X2, X7, and X8 (Y1, Y2, Y7, and Y8) are coupled to the vacuum so that the substrate P is sucked to the placing table 105.

Referring back to FIG. 6, in a step S106, the drawing pattern B is obtained. The CPU 11 reads the coordinate data of each color pixel so as to calculate the read coordinate data and obtain the drawing pattern B of which the longitudinal direction is in the Y-axis direction. Thereafter, the coordinate data of the read drawing pattern B is corrected for the rotation of the substrate P by using a coordinate of the rotation center CZ (refer to FIGS. 2A and 2B) of the rotation unit 110 so as to obtain the data of the drawing pattern B of which after the longitudinal direction is rotated to the X-axis direction. The coordinate of the rotation center CZ of the rotation unit 110 is preliminary stored in the memory 12. The CPU 11 reads and uses the stored coordinate of the rotation center CZ.

In a step S107, the carriage is positioned. In order to draw color patterns of R, G, and B to the color filter 50, the CPU 11 drives the linear motor to move the carriage moving stage 112 of the carriage 200 along the guide rails 102 so that the carriage 200 is positioned at the drawing start position calculated by the coordinate data of the corrected drawing pattern B.

Figure 9:
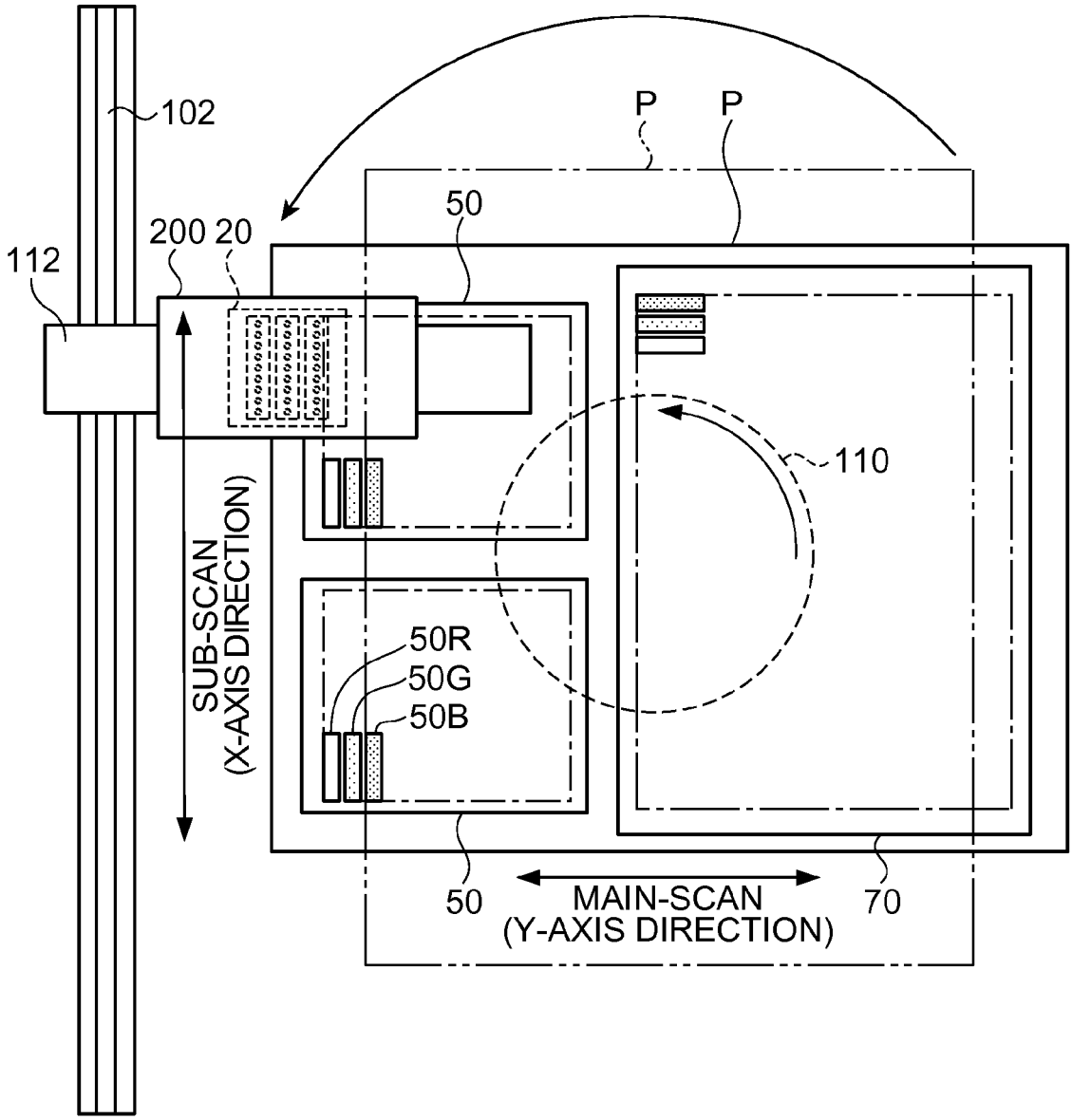
FIG. 9 is a schematic view showing a state in which the pattern to form the color filter is drawn by the nozzle head.

Next, in a step S108, the substrate is moved as the main-scan (in the Y-axis direction) and the carriage is moved as the sub-scan (in the X-axis direction) so as to draw the drawing pattern B. This processing will be explained with reference to FIG. 9. FIG. 9 is a schematic view showing a state in which the color filter 50 is drawn by the nozzle head 20 included in the carriage 200 when the substrate P is viewed from the top. The substrate P is rotated 90 degrees in a counterclockwise direction (in an arrow direction in the drawing) by the rotation of the rotation unit 110. One of the pair of guide rails 102 (in the right side of the FIG. 9) is omitted so as to simplify the drawing.

As shown, the substrate P is moved along the pair of guide rails 101 (not shown) in the Y-axis direction as the main-scan. During the main-scan, the piezoelectric element in the discharge mechanism provided to respective nozzles of the nozzle head 20 is driven so as to discharge each color liquid body to the regions 50R, 50G, and 50B (FIG. 9 shows only a part of the regions) from respective nozzles. On the other hand, the carriage 200 is moved along the pair of the guide rails 102 in the X-axis direction as the sub-scan. At each time of the sub-scan of the carriage 200, the substrate P is repeatedly moved in the Y-axis direction as the main-scan so as to discharge each color liquid body to all regions 50R, 50G, and 50G. The drawing pattern B which is the drawing pattern for the two pieces of the color filters 50 is thus drawn.

Referring back to FIG. 6, in a step S109, the substrate is separated. The CPU 11 controls the control valves 160 and 170, and couples all of the holes from X1 to X8, and Y1 to Y8 to the compressed air so that the substrate P placed on the predetermined position of the placing table 15 is separated from the table surface. Through the steps described above, all drawing process is completed. Thereafter, the substrate P which is separated from the table surface is removed from the liquid body discharge device 100.

According to the liquid body discharge device 100 of the embodiment, the substrate P is rotated without lifting and lowering it while the substrate P remains on the placing table 105 so that the color filters 70 and 50 having different drawing patterns can be formed by drawing. The drawing patterns are different from each other in regard to the longitudinal directions of the liquid body discharged region. Therefore, operations, e.g., removing the substrate from the device, rotating it 90 degrees, and resetting it on the device, are unnecessary so that lowering the productivity can be prevented.

It should be understood that the invention is not limited to the above-mentioned embodiment, and various changes can be made without departing from the spirit and scope of the invention. Hereinafter, modifications will be described.

First Modification

In the embodiment above, the holes X3 to X6 and Y3 to Y6 at which formed the rotation unit 110 are all coupled to the vacuum when the substrate P is rotated so that the substrate P is sucked to the rotation unit 110. However, the holes positioned at an edge part which is distant from the rotation center CZ may not be coupled to the vacuum. Thus, the substrate P is not sucked to the rotation unit 110 at the edge part of the rotation unit 110. It makes a separation distance between the surface of the placing table 105 which is adjacent to the edge part of the rotation unit 110 and the substrate P larger. As a result, the friction between the surface of the placing table 105 and the substrate P in accordance with the rotation can be suppressed even if there is a structural step between the edge part of the rotation unit 110 and the placing table 105, for example.

Figure 10:
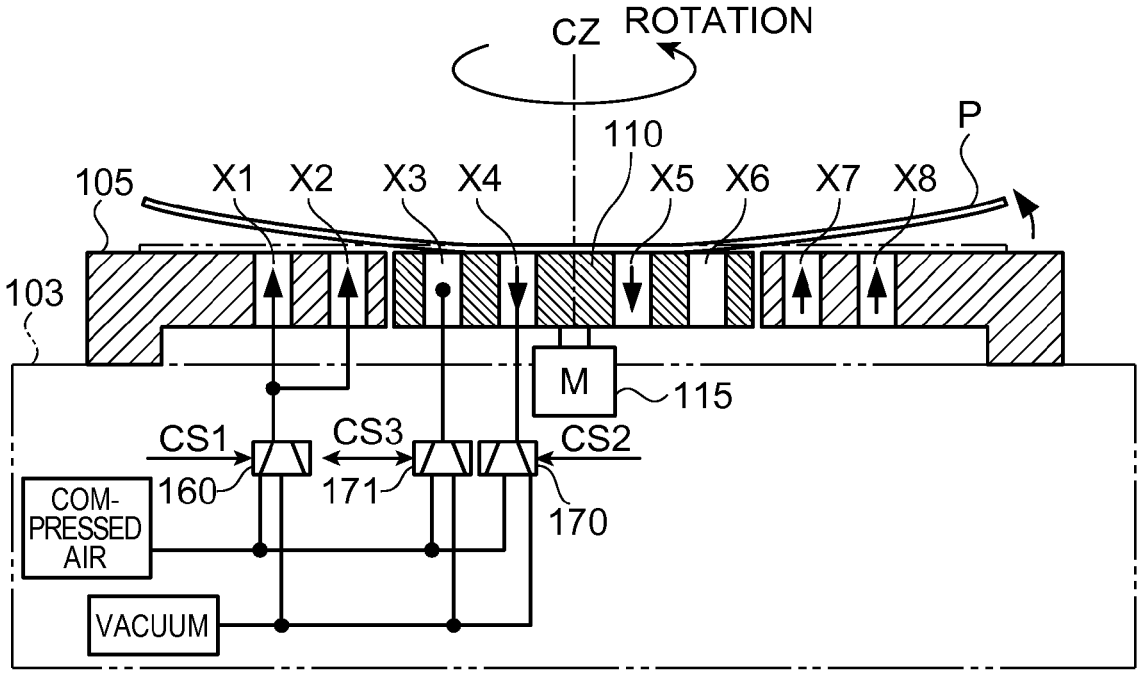
FIG. 10 is a schematic view explaining the rotation of the substrate of a first modification.

The first modification will be described with reference to FIG. 10. FIG. 10 is a cross sectional view taken along the line A-A of the placing table 105 in the same manner as FIG. 2B. As shown, in the step S105 in FIG. 6, the control valve 160 couples the holes X1, X2, X7, and X8 (Y1, Y2, Y7, and Y8 (refer to FIG. 2A)) to the compressed air by the control signal CS1 similarly to the above embodiment. On the other hand, in the modification, the holes X4 and X5 (Y4 and Y5 (refer to FIG. 2A) which are close to the rotation center CZ are coupled to the vacuum with the control valve 170 controlled by the control signal CS2 while the holes X3 and X6 (Y3 and Y6 (refer to FIG. 2A)) which are distant from the rotation center CZ and positioned at the edge part of the rotation unit 110 are not coupled to the vacuum with a control valve 171 which is newly provided controlled by a control signal CS3. In the modification, the holes X3 and X6 (Y3 and Y6) are controlled to be in a state in which the holes are coupled to neither the compressed air nor the vacuum. Except for the vacuum (including the depressurized air), of course, the holes may be controlled to be coupled to the air or the compressed air.

As a result, as shown, the part of the substrate P placed over the rotation unit 110, around the rotation center CZ which is a predetermined area based on a formation position of the holes X4, X5, Y4, and Y5, is sucked to the surface of the placing table 105 by the vacuum. However, the other part of the substrate P which is placed other than the rotation unit 110, the substrate P is separated from the surface of the placing table 105 by the compressed air. Accordingly, as shown, the substrate P at the edge part of the rotation unit 110 is placed having a larger separation distance from the surface of the placing table than the above embodiment.

The substrate P placed as above, when the rotation unit 110 is rotated the predetermined degrees (90 degrees), the substrate P is sucked around the rotation center CZ of the rotation unit 110 so that the substrate P is rotated with the rotation unit 110. At the edge part of the rotation unit 110, the substrate P is widely separated from the surface of the placing table 105 so that the surface of the placing table 105 and the substrate P can be rotated without any friction.

Thereafter, when the substrate P is rotated the predetermined degrees, the control valves 160 and 171 are respectively controlled by the control signals CS1 and CS3, and the holes X1, X2, X7, and X8 (Y1, Y2, Y7, and Y8) and the holes X3 and X6 (Y3 and Y6) are coupled to the vacuum so that the substrate P is sucked to the placing table.

Second Modification

In the embodiment above, the rotation unit 110 is rotated by using the rotary motor 115. However, it is needless to say, the invention is not limited to this. For example, the rotation unit 110 may be rotated by blowing the air from the holes formed at the placing table 105. Accordingly, the rotary motor 115 becomes unnecessary so that the structure of the placing table 105 is simplified.

Figure 11A:
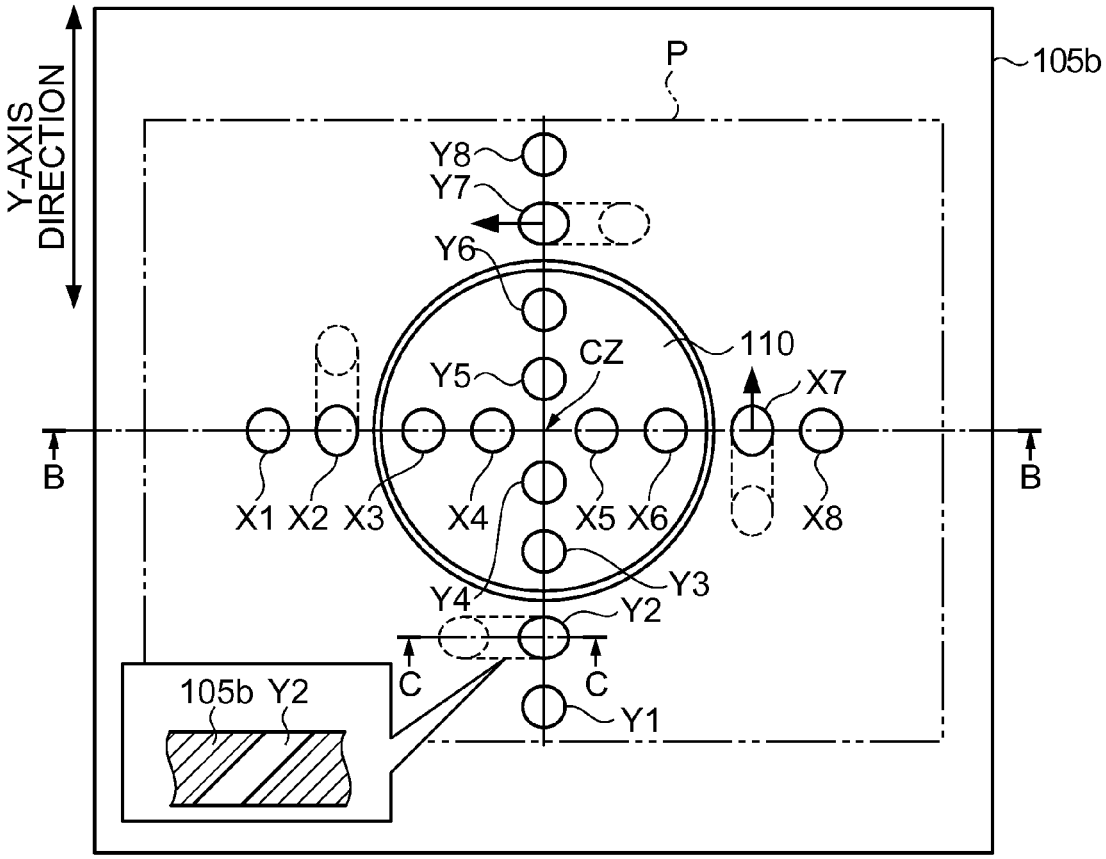
FIGS. 11A and 11B are schematic views explaining the rotation of the substrate.
Figure 11B:
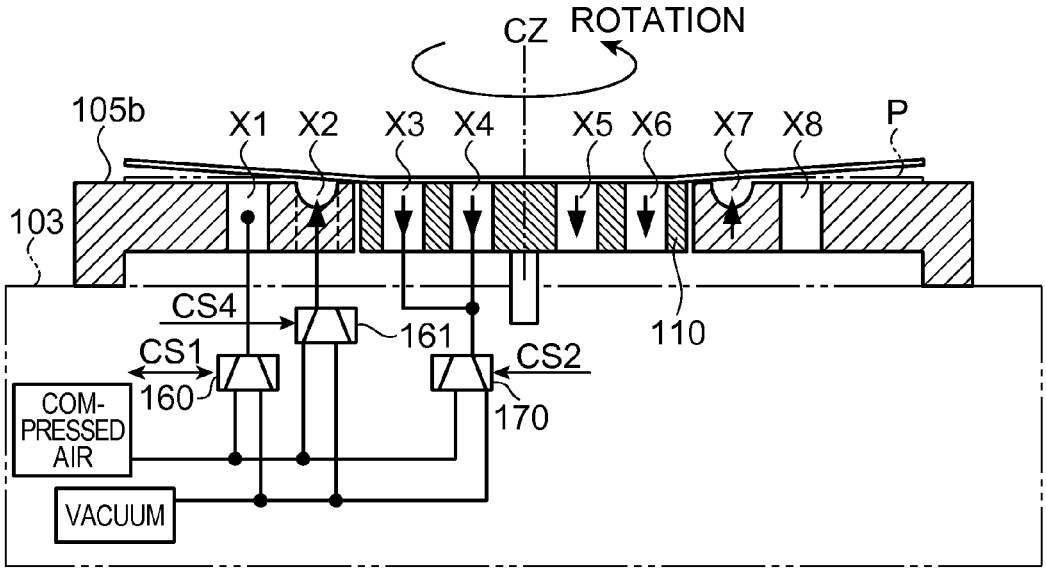

The second modification will be described with reference to FIGS. 11A and 11B. FIGS. 11A and 11B are structure views schematically showing the suction unit and the separation unit structured on the placing table 105 as shown in FIGS. 2A and 2B. FIG. 11A shows a placing table 105*b* when it is viewed from the upper direction. FIG. 11B is a cross sectional view taken along a line B-B of the placing table 105*b* in FIG. 11A. In the modification, only the holes X2, X7, Y2, and Y7 are different from the embodiment above. Therefore, except for the holes X2, X7, Y2, and Y7, the description of remaining parts is basically the same as that of the embodiment above (FIGS. 2A and 2B) so that it is omitted. The holes X2, X7, Y2, and Y7 will be described here.

As shown, the holes X2, X7, Y2, and Y7 are formed to have a blowing direction of the air is oblique from the placing table 105*b* with respect to the surface on which the substrate P is placed. A cross sectional view taken along a line C-C of the hole Y2 is shown in a balloon in FIG. 11A as an example. Then, the blowing direction of the air from each of the holes X2, X7, Y2, and Y7 is respectively formed to have the counterclockwise direction around the rotation center CZ when the placing table 105*b* is viewed from the upper direction. For example, the blowing direction of the air from the hole X7 is in the Y-axis direction as indicated by the arrow in the drawing, and the blowing direction of the air from the hole Y7 is in a direction orthogonal to the Y-axis direction as indicated by the arrow.

When the rotation unit 110 is rotated the predetermined degrees (90 degrees) in the step S105 (FIG. 6), in the modification, the substrate P is rotated in the counterclockwise direction without using the rotary motor 115. That is, as shown in the FIG. 11B, the control valve 170 couples the holes X3 and X4 (X5, X6, Y3, Y4, Y5, and Y6 also) to the vacuum by the control signal CS2. On the other hand, a control valve 161 which is newly provided couples the hole X2 (the holes X7, Y2, and Y7 also) to the compressed air by a control signal CS4.

Here, in the above embodiment, the control valve 160 couples the hole X1 (the holes X8, Y1, and Y8 also) to the compressed air by the control signal CS1. However, in the modification, the control valve 160 controls not to couple the holes to the compressed air. The holes are not couples to the vacuum, either. In this way, the rotation unit 110 is expected to be rotated effectively by the air blown from the holes X2, X7, Y2, and Y7. It is needless to say that the control valve 160 may couple the hole X1 (the holes X8, Y1, and Y8 also) to the compressed air by the control signal CS1 as the embodiment above.

As a result, as shown, the part of the substrate P which is placed over the rotation unit 110 is sucked to a surface of the placing table 105*b* by the vacuum. On the other hand, the other part of the substrate P which is placed other than the rotation unit 110 is separated from the surface of the placing table 105*b* by the air blown from the holes X2, X7, Y2, and Y7. At this time, the substrate P is separated and rotated in the counterclockwise direction around the rotation center CZ by the air blown from the holes X2, X7, Y2, and Y7. Therefore, the substrate P can be separated and rotated simultaneously so that the rotation time of the substrate P is expected to be reduced.

Thereafter, when the substrate P is rotated the predetermined degrees, the control valve 160 is controlled by the control signal CS1, and the holes X1 and X2 (X7, X8, Y1, Y2, Y7, and Y8 also) are coupled to the vacuum so that the substrate P is sucked to the placing table 105. In the embodiment above, whether the substrate P is rotated the predetermined degrees or not can be detected by the rotation number of the rotary motor 115 and the like. However, the rotary motor 115 is not provided in the modification so that a detection sensor may be provided to detect the rotation of the substrate P.

Figure 6:
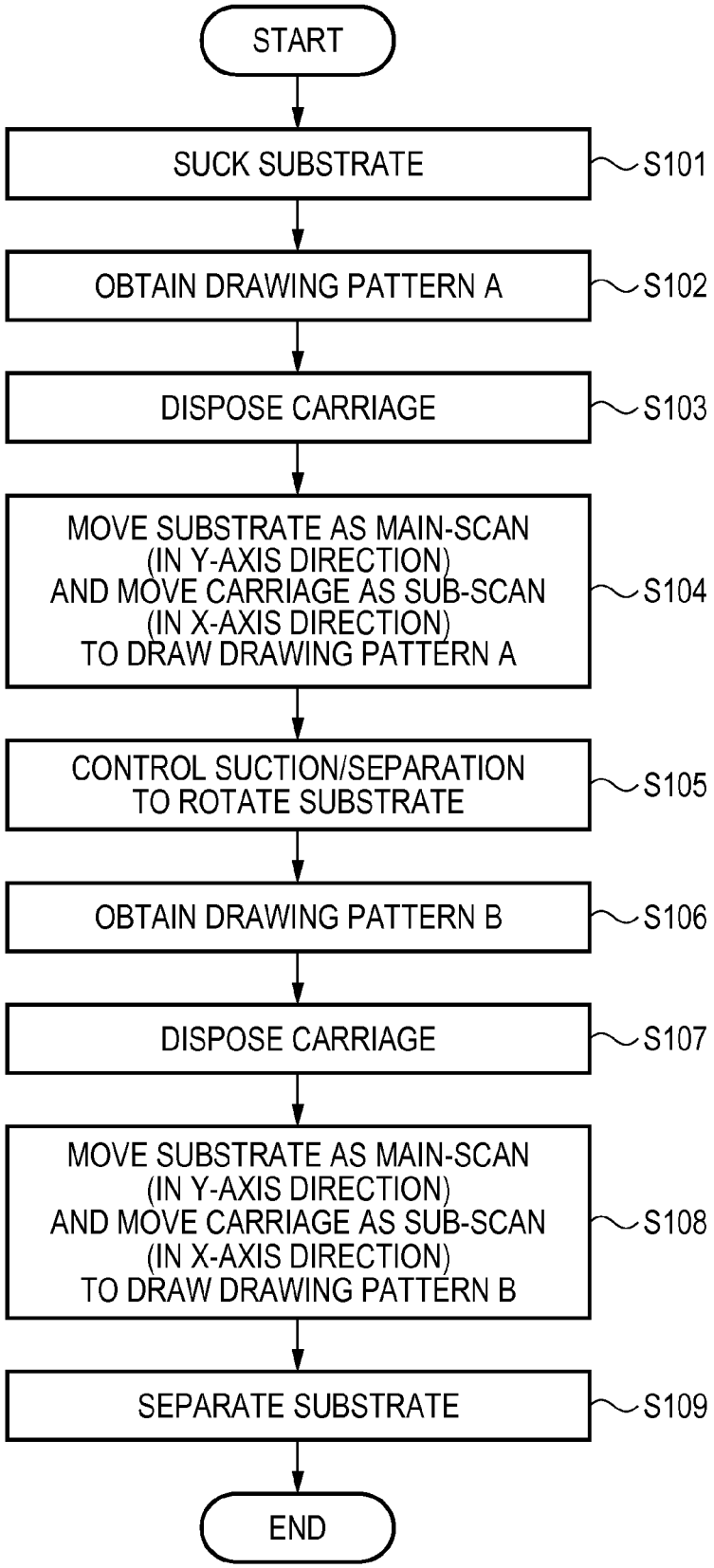
FIG. 6 is a flowchart showing processing steps conducted by the liquid body discharge device of the embodiment.

In the modification, when the substrate P is separated in the step S109 in FIG. 6, instead of blowing the air from all the holes formed at the placing table 105*b*, the control valve 161 is controlled by the control signal CS4 so that the air is not blown from the holes X2, X7, Y2, and Y7 from which the blowing direction of the air is oblique. In this way, when removing the substrate P from the device, the air is blown from the holes formed vertically so that rotation of the substrate P by the air can be prevented. Accordingly, when removing the substrate P from the placing table, a removing operation can be easier since the substrate P does not rotate.

In the modification, the holes X2, X7, Y2, and Y7 which are closer to the rotation unit 110 than the edge part of the placing table 105*b* among the holes formed thereat are formed to have the blowing direction of the air is oblique. However, needless to say, it is not only limited to this. For example, the holes X1, X8, Y1, and Y8 which are further to the edge part of the placing table 105*b* than the rotation unit 110 may be formed to have the blowing direction of the air is oblique. In this way, a torque of the rotation center CZ can be expected to be increased so that the rotation of the substrate P can be easier.

In the modification, the holes X2, X7, Y2, and Y7 are formed to have one direction (the counterclockwise direction) of the rotating direction when the substrate P is rotated. Further, holes from which the blowing direction of the air is a clockwise direction may be formed so that the substrate P can be rotated in a reverse direction. As a result, controlling the air blown from the holes allows the substrate P to be able to be rotated in different directions.

Other Modifications

In the embodiment above, a shape of the liquid body discharged region is usually in a rectangular shape of which each side are orthogonal to each other, thereby the longitudinal directions of each pixel of the color filters 50 and 70 are orthogonal to each other so that the substrate P is rotated 90 degrees. However, it is not limited to this. For example, when an angle formed by each longitudinal direction of the two drawing patterns is not 90 degrees, it is preferable that the substrate P is rotated in accordance with the angle formed by each longitudinal direction. Thus, the substrate P can be moved as the main-scan in an appropriate direction in accordance with the each drawing pattern. As a result, the substrate P is rotated without lifting and lowering while it remains on the placing table 105 so that the color filters having two drawing patterns can be formed by drawing. The drawing patterns are different from each other in regard to the longitudinal directions of the liquid body discharged regions.

In addition, in the embodiment above, the suction unit and the separation unit are configured by coupling the holes formed at the placing table to the compressed air or the vacuum. However, it is not limited to this, e.g., an electrostatic suction unit using a static charge, or a magnetic attraction unit and an electromagnetic suspension unit using a magnet may be employed for the suction unit and the separation unit.

In the embodiment above, the substrate P is moved in the Y-axis direction as the main-scan while the carriage 200 is moved in the X-axis direction as the sub-scan. However, it is not particularly limited to this, thus needless to say, e.g., the substrate P may be moved in the X-axis direction and the Y-axis direction as the main-scan and the sub-scan while the carriage 200 is moved in the X-axis direction and the Y-axis direction as the main-scan and the sub-scan. The point is that the nozzles and the substrate are structured so as to relatively move in the main-scan and the sub-scan. In this case, though a description will be omitted, structures of the moving table 103, the carriage moving stage 112, and the like are obviously different from those in the embodiment.

Further, in the embodiment above, the moving stage 103 and the carriage moving stage 112 are moved by a moving unit including the air sliders and the linear motors provided inside the guide rails 101 and 102. However, it is not particularly limited to this, and thus a moving unit including a motor and a belt or a moving unit including a ball screw and a motor may also be employed. In other words, any structure is applicable by which the moving stage 103, the placing table 105, and the carriage moving stage 112 can be moved.

In the embodiment above, the color pixels formed in the color filters 50 and 70 are arranged in a stripe arrangement in which the color pixels of the same color are consecutively formed in the longitudinal direction of the color pixels. However, it is not limited to this, and they may be arranged in a delta arrangement or a mosaic arrangement. In addition, the number of colors of the color filters is three of R, G, and B. However, it is not limited to this, the number of colors may be increased to four or decreased to two, for example.

In the embodiment, a relation of the sizes of each color pixel of the color filters 50 and 70 is not particularly described. The color filters 50 and 70 may have color pixels having a same size or may have color pixels having different sizes and shapes from each other. In other words, any pixel can be employed as long as it has a longitudinal side and a shape that meets the descriptions described with reference to FIG. 5.

Further, in the embodiment, the liquid body discharge device 100 that discharges each color liquid body on the substrate so as to form the color filter is described as the liquid body discharge device. However, needless to say, it is not limited to this. For example, the invention may be practiced with a manufacturing device to form a metal wiring pattern by discharging a functional liquid containing a metal material to a silicon substrate, a ceramic substrate, or a resin substrate, as well as a glass substrate, or with a device for manufacturing an organic EL element to form a light emitting element by discharging a functional liquid containing a light-emitting material made of an organic material as a solute to a liquid discharged region formed on the substrate. In other words, the invention can be similarly practiced by any device as long as the device can record a pattern such as an image or a graphic, or a letter on a liquid body discharged object such as a substrate by discharging a functional liquid using a method for discharging a liquid body.

The entire disclosure of Japanese Patent Application No. 2008-028491, filed Feb. 8, 2008 is expressly incorporated by reference herein.

What is claimed is:

1. A placing table, comprising:

a placing surface on which a substrate is placed;

a suction unit which sucks the substrate to the placing surface;

a separation unit which separates the substrate from the placing surface;

a rotation unit, being a part of the placing surface and rotating about a vertical axis with respect to the placing surface, wherein the suction unit sucks the substrate to the placing surface at the rotation unit and the separation unit separates the substrate from a part of the placing surface excluding the rotation unit if the rotation unit is rotated; and an opening hole provided to the placing surface, wherein the opening hole is formed in an oblique direction with respect to the placing surface, and the separation unit blows a gas from the opening hole formed in the oblique direction so that the substrate is separated and the rotation unit is rotated.

2. The placing table according to claim 1, wherein the suction unit does not suck the substrate at an edge part of the rotation unit.

3. The placing table according to claim 1, wherein the rotation unit is in a circular shape when viewed vertically to the placing surface.

4. The placing table according to claim 1, wherein the placing surface further includes an opening hole formed in a nearly vertical direction with respect to the placing surface, and the separation unit blows the gas from the opening hole formed in the vertical direction so that the whole substrate is separated from the placing surface.

5. A liquid body discharge device, comprising:

the placing table according to claim 1; and a liquid discharge unit that discharges a liquid body to the substrate with a nozzle.

* * * * *